US008876662B2

(12) United States Patent
Hao

(10) Patent No.: US 8,876,662 B2
(45) Date of Patent: Nov. 4, 2014

(54) TABLE FOR USE WITH WORKOUT EQUIPMENT

(71) Applicant: Dyaco International Inc., Taipei (TW)

(72) Inventor: Kuo-Wo Hao, Hemei Town (TW)

(73) Assignee: Dyaco International Inc., Taipei (TW)

( * ) Notice: Subject to any disclaimer, the term of this patent is extended or adjusted under 35 U.S.C. 154(b) by 108 days.

(21) Appl. No.: 13/665,519

(22) Filed: Oct. 31, 2012

(65) Prior Publication Data

US 2013/0231216 A1 Sep. 5, 2013

(30) Foreign Application Priority Data

Mar. 3, 2012 (TW) ..... 101203843 U

(51) Int. Cl.
*A63B 24/00* (2006.01)

(52) U.S. Cl.
USPC ..... 482/4

(58) Field of Classification Search
USPC ..... 482/1–9, 51–54, 900–902; 434/247
See application file for complete search history.

(56) References Cited

U.S. PATENT DOCUMENTS

| | | | | |
|---|---|---|---|---|
| 6,224,516 | B1 * | 5/2001 | Disch | 482/54 |
| 7,497,812 | B2 * | 3/2009 | Neff et al. | 482/72 |
| 7,614,991 | B2 * | 11/2009 | Fox | 483/54 |
| 7,686,742 | B2 * | 3/2010 | Tischler et al. | 482/57 |
| 7,780,578 | B2 * | 8/2010 | Packham | 482/54 |

* cited by examiner

*Primary Examiner* — Glenn Richman
(74) *Attorney, Agent, or Firm* — Huffman Law Group, PC

(57) ABSTRACT

A table for use with a workout equipment is provided. The table includes a base, a table board and a supporting stand. The base has a front shielding portion, two lateral shielding portions, and a receiving space defined by the front shielding portion and the lateral shielding portions. The supporting stand is disposed between the base and the table board and is of a length adjustable to change the distance between the table board and the base. Accordingly, the table operates in conjunction with any workout equipments that come in various types or styles to enable a user to exercise and work concurrently and conveniently.

11 Claims, 13 Drawing Sheets

TABLE FOR USE WITH WORKOUT EQUIPMENT

BACKGROUND OF THE INVENTION

1. Technical Field

The present invention relates to workout equipments, and more particularly, to a table for use with a workout equipment and a workout equipment assembly for use with the table.

2. Description of Related Art

Plenty of people are too busy working to exercise outdoors, and thus they often have a workout with an indoor workout equipment, such as a treadmill, a bicycle, or an elliptical trainer, while reading or working. A conventional workout equipment typically has a control panel positioned in front of the user's body and designed to support a book or a work-related document, thereby lacking ease of use. A commercially-available table which straddles a treadmill and supports a book, a work-related document, and a notebook computer to thereby feature ease of use.

A treadmill is much different from a bicycle, an elliptical trainer, and any other workout equipment in shape, and thus the table does not apply to different types of workout equipments. Furthermore, the tilting angle of the vertical rod at the front end of a treadmill varies from treadmill to treadmill, and thus the table does not apply to different forms of treadmills.

SUMMARY OF THE INVENTION

In view of the aforesaid drawbacks of the prior art, it is an objective of the present invention to provide a table for use with a workout equipment and a workout equipment assembly for use with the table, wherein the table operates in conjunction with any workout equipments that come in various types or styles to enable a user to exercise and work concurrently and conveniently.

In order to achieve the above and other objectives, the present invention provides a table for use with a workout equipment. The table comprises a base, a table board, and a supporting stand. The base has a front shielding portion, two lateral shielding portions extending backward from the front shielding portion, and a receiving space defined by the front shielding portion and the two lateral shielding portions, such that a front end of the workout equipment is disposed in the receiving space. The supporting stand is disposed between the base and the table board and is of a length adjustable to change a distance between the table board and the base.

Furthermore, the present invention provides a workout equipment assembly comprising a table and a workout equipment. The table comprises a base, a table board and a supporting stand. The base has a front shielding portion, two lateral shielding portions extending backward from the front shielding portion, and a receiving space defined by the front shielding portion and the two lateral shielding portions. The table board has a bottom surface facing the receiving space of the base. The supporting stand is disposed between the base and the table board and is of a length adjustable to change a distance between the table board and the base. The height of the front end of the workout equipment is less than the maximum distance between the bottom surface of the table board and the receiving space. The front end of the workout equipment is disposed in the receiving space of the table.

Hence, the table enables a user to adjust the height of the table board according to the type and style of a workout equipment. Various workout equipments can be designed to have a front end of a relatively small height, such that the table can operate in conjunction with workout equipments of various types or various styles, thereby enabling the user to exercise and work concurrently and conveniently.

The structures, features, assembly or use of a table for use with a workout equipment and a workout equipment assembly for use with the table according to the present invention are described in detail below. However, persons skilled in the art understand that the detailed description and specific embodiments of the present invention are illustrative of the present invention rather than restrictive of the claims of the present invention.

BRIEF DESCRIPTION OF THE SEVERAL VIEWS OF THE DRAWINGS

Objectives, features, and advantages of the present invention are hereunder illustrated with specific embodiments in conjunction with the accompanying drawings, in which.

DETAILED DESCRIPTION OF THE EMBODIMENTS OF THE INVENTION

Figure 1:
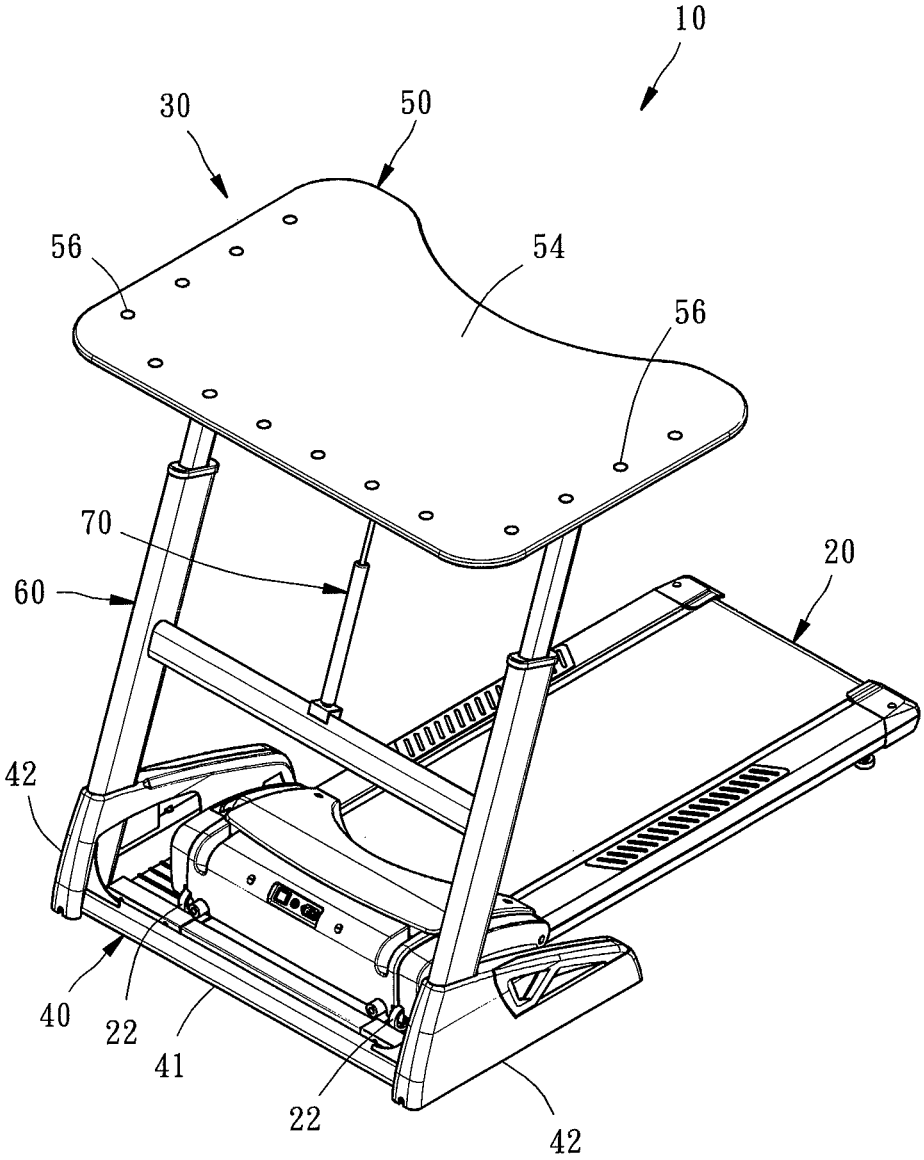
FIG. 1 is an assembled perspective view of a workout equipment assembly according to a first preferred embodiment of the present invention.
Figure 2:
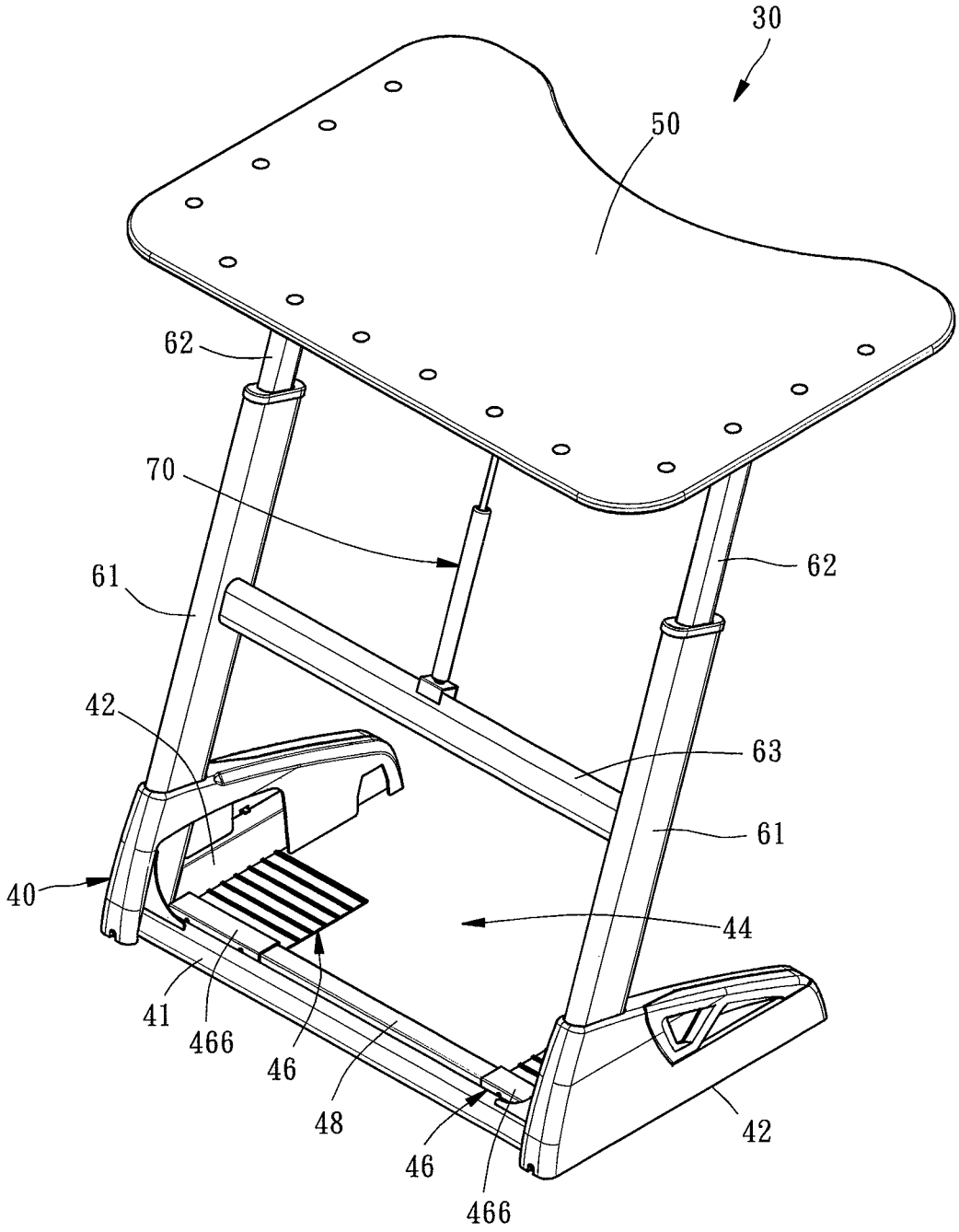
FIG. 2 is an assembled perspective view of a table for use with a workout equipment assembly according to the first preferred embodiment of the present invention.

Referring to FIG. 1 through FIG. 7, in a first preferred embodiment of the present invention, a workout equipment assembly 10 comprises a workout equipment 20 and a table 30.

The table 30 comprises a base 40, a table board 50, and a supporting stand 60.

The base 40 has a front shielding portion 41, two lateral shielding portions 42 extending backward from the front shielding portion 41, and a receiving space 44 defined by the front shielding portion 41 and the two lateral shielding portions 42.

The table board 50 has a bottom surface 52. The bottom surface 52 faces the receiving space 44 of the base 40.

Figure 3:
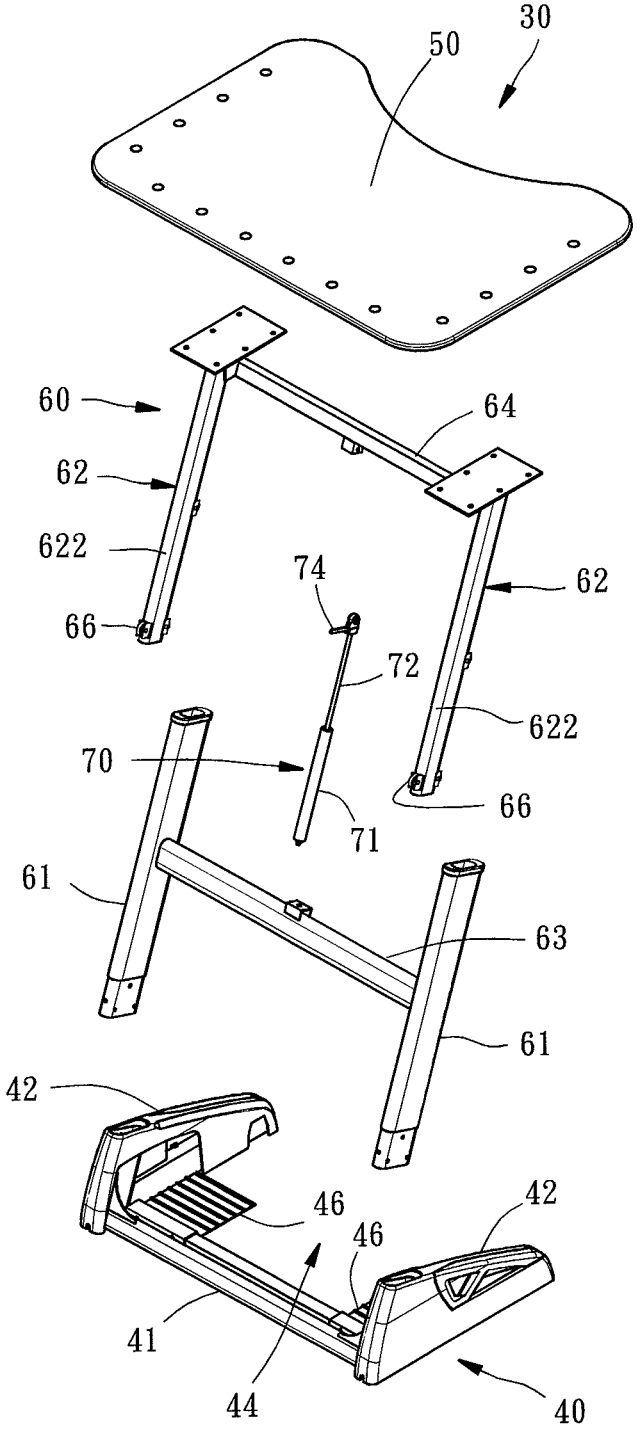
FIG. 3 is an exploded view of a table for use with a workout equipment assembly according to the first preferred embodiment of the present invention.

The supporting stand 60 has a hollow core and is disposed between the base 40 and the table board 50. The length of the supporting stand 60 is adjustable to thereby change the distance between the table board 50 and the base 40. In this embodiment, the supporting stand 60 comprises two first vertical rods 61, two second vertical rods 62, a first transverse rod 63 fixedly disposed between the two first vertical rods 61, and a second transverse rod 64 fixedly disposed between the two second vertical rods 62, as shown in FIG. 3. The two first vertical rods 61 are fixedly disposed on the two lateral shielding portions 42, respectively. The two second vertical rods 62 are slidably nested in the two first vertical rods 61, respectively. The table board 50 is fixedly disposed on the two second vertical rods 62. Hence, the second vertical rods 62, the second transverse rod 64, and the table board 50 can simultaneously slide upward and downward relative to the first vertical rods 61, the first transverse rod 63, and the base 40, so as to change the length of the supporting stand 60 and the distance between the table board 50 and the base 40. However, the aforesaid disclosure is not restrictive of the structure of the supporting stand 60. For example, it is also feasible that the supporting stand 60 has one first vertical rod 61 and one second vertical rod 62 only.

In this embodiment, the table 30 further comprises a pneumatic unit 70 with two ends fixed to the first transverse rod 63 and the second transverse rod 64, respectively. The pneumatic unit 70 comprises a first pole 71, a second pole 72, and an operation lever 74. Once a user presses the operation lever 74, the second pole 72 will automatically slide upward relative to the first pole 71 to thereby abut against the second transverse rod 64 from below. Alternatively, the user can press the operation lever 74 and the table board 50 simultaneously to thereby drive the second pole 72 to slide downward relative to the first pole 71 and shorten the supporting stand 60. The principle of operation of the pneumatic unit 70 is disclosed in the prior art and thus is not described herein for the sake of brevity. The position of the pneumatic unit 70 is not limited by the present invention but will be acceptable on condition that the two ends of the pneumatic unit 70 are fixed to the base 40 and the table board 50, respectively. Given the pneumatic unit 70, the user can lift the table board 50 easily to increase the distance between the table board 50 and base 40. Furthermore, the second pole 72 becomes stationary as soon as the user stops pressing the operation lever 74. However, the technical feature "the table 30 operable and adjustable by the user by means of the pneumatic unit 70 to thereby fix the distance between the table board 50 and the base 40" is not restrictive of the present invention. For instance, it is also feasible that the supporting stand 60 is equipped with a positioning bolt whereby the user adjusts the length of the supporting stand 60 manually and fixes the length of the supporting stand 60.

Figure 4:
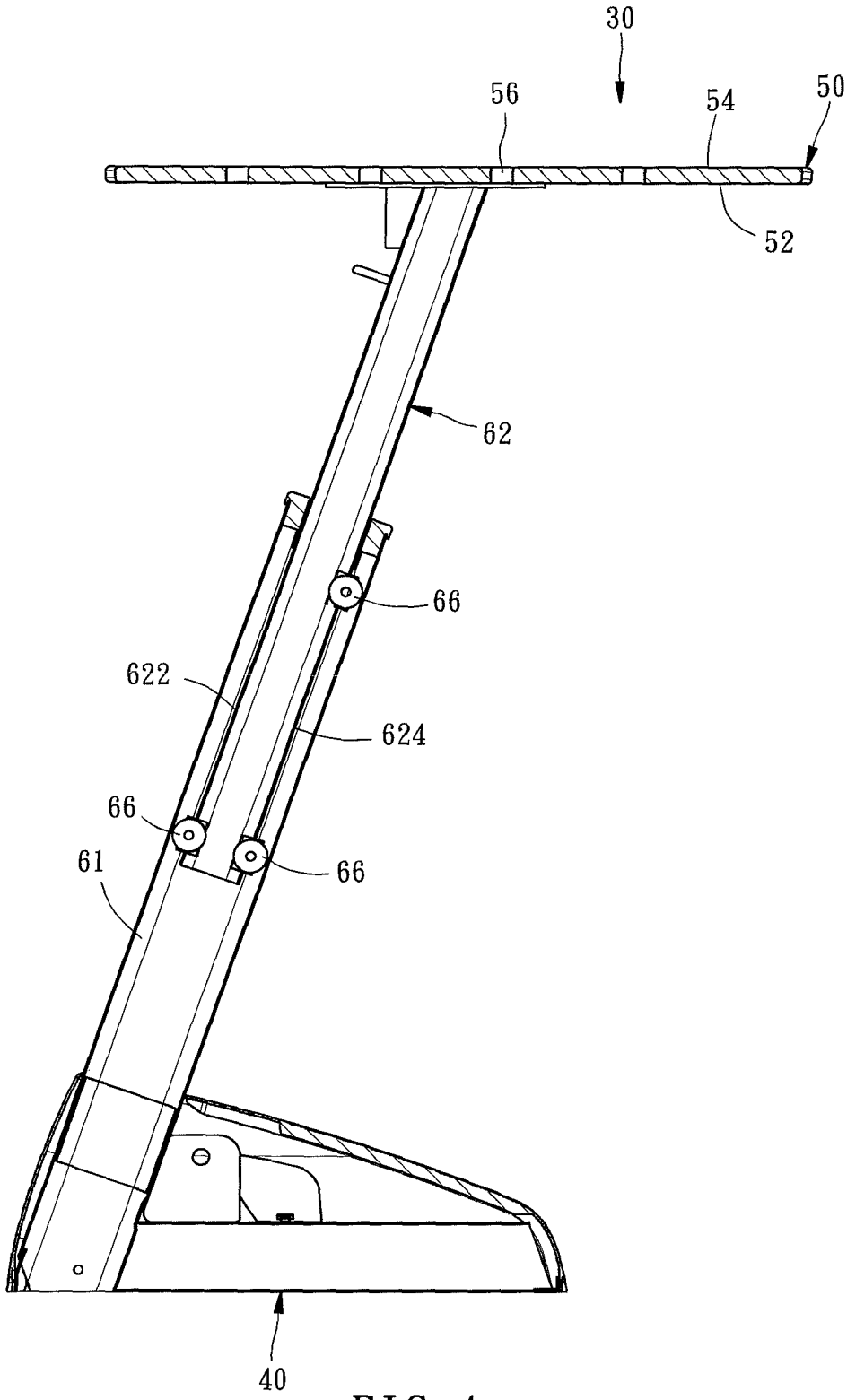
FIG. 4 is a cross-sectional view of a table for use with a workout equipment assembly according to the first preferred embodiment of the present invention.

To allow the first and second vertical rods 61, 62 to slide relative to each other smoothly, at least a roller 66 is disposed between the second vertical rods 62 and the first vertical rods 61. In this embodiment, the first and second vertical rods 61, 62 extend obliquely upward and backward. Referring to FIG. 4, a roller 66 is disposed between a front side 622 on the front of each of the second vertical rods 62 and the first vertical rods 61 and bears a relatively small weight, whereas two rollers 66 are disposed between a back side 624 on the back of each of the second vertical rods 62 and the first vertical rods 61 and bear a relatively large total weight. Hence, the rollers 66 not only enable the second vertical rods 62 to slide smoothly but are also unlikely to get damaged when overloaded.

Figure 8:
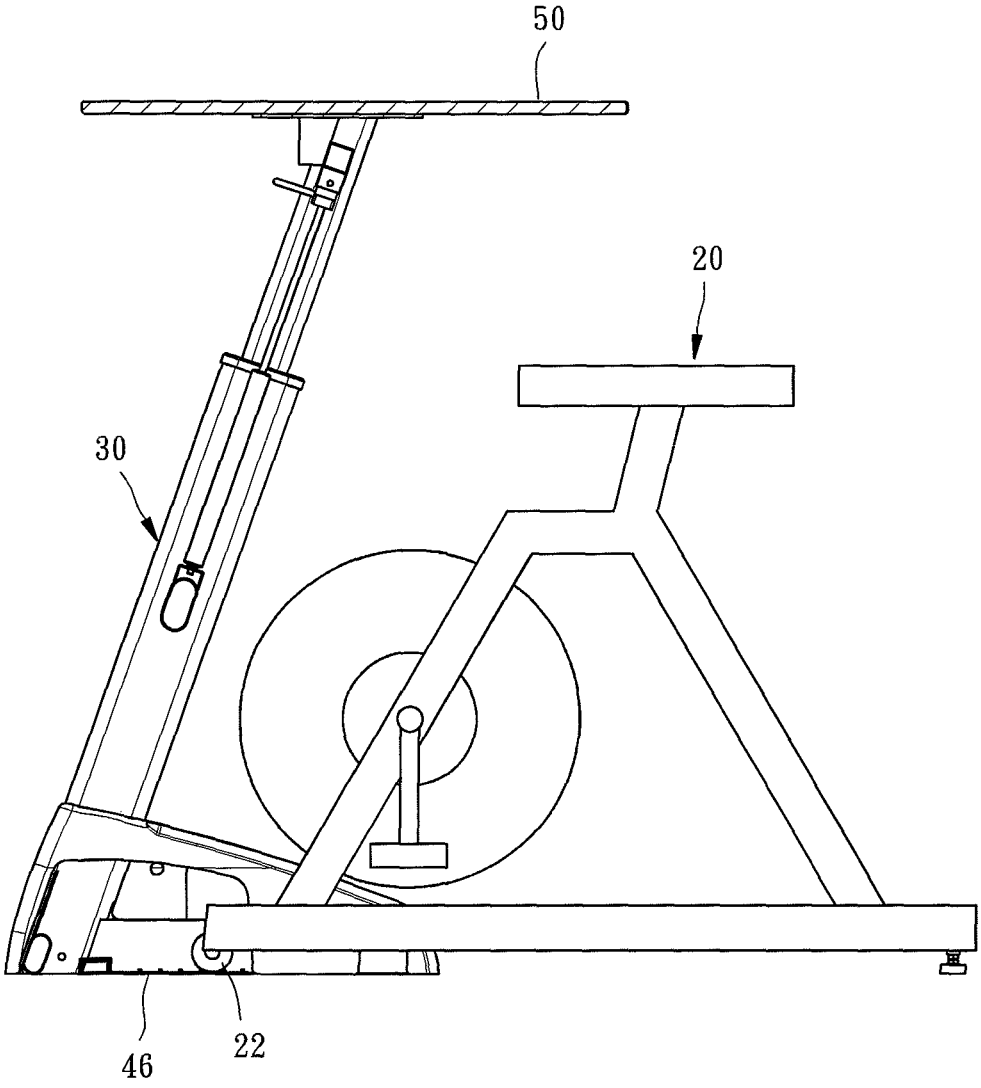
FIG. 8 is a cross-sectional schematic view of a workout equipment assembly according to a second preferred embodiment of the present invention.
Figure 9:
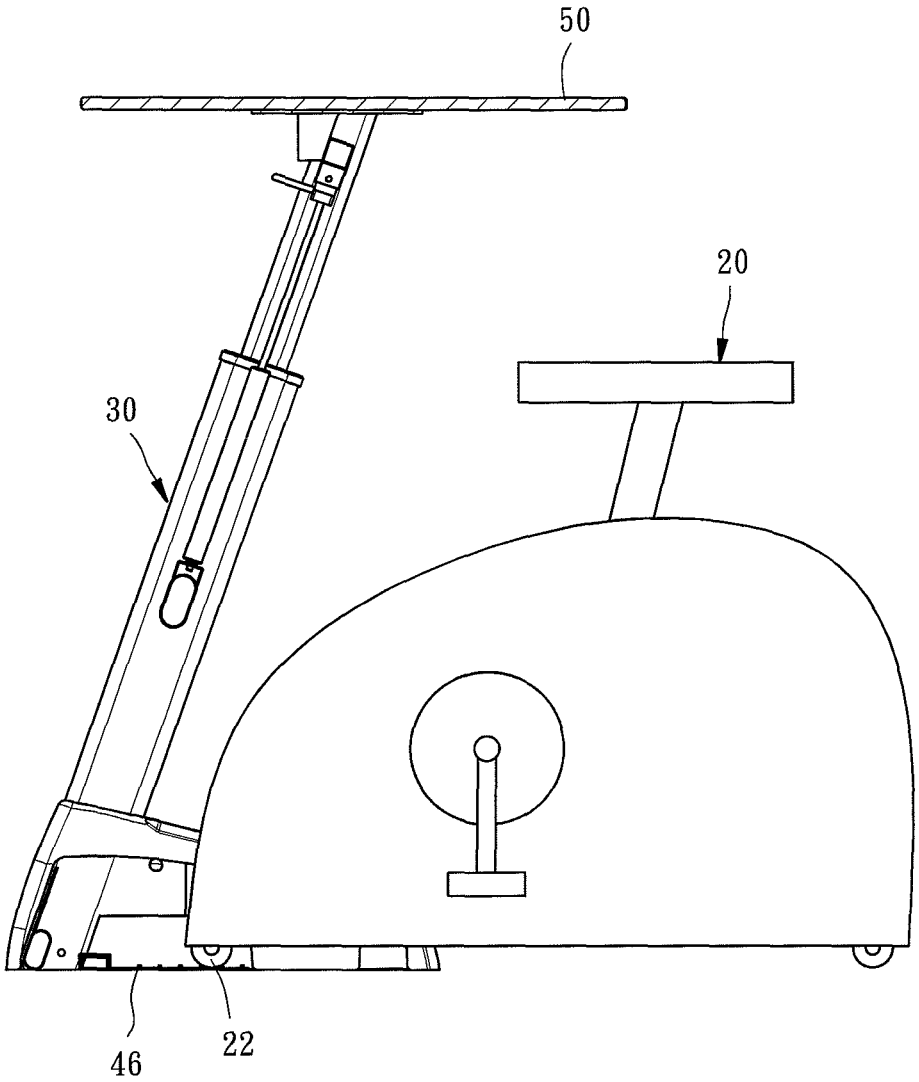
FIG. 9 is a cross-sectional schematic view of a workout equipment assembly according to a third preferred embodiment of the present invention.
Figure 10:
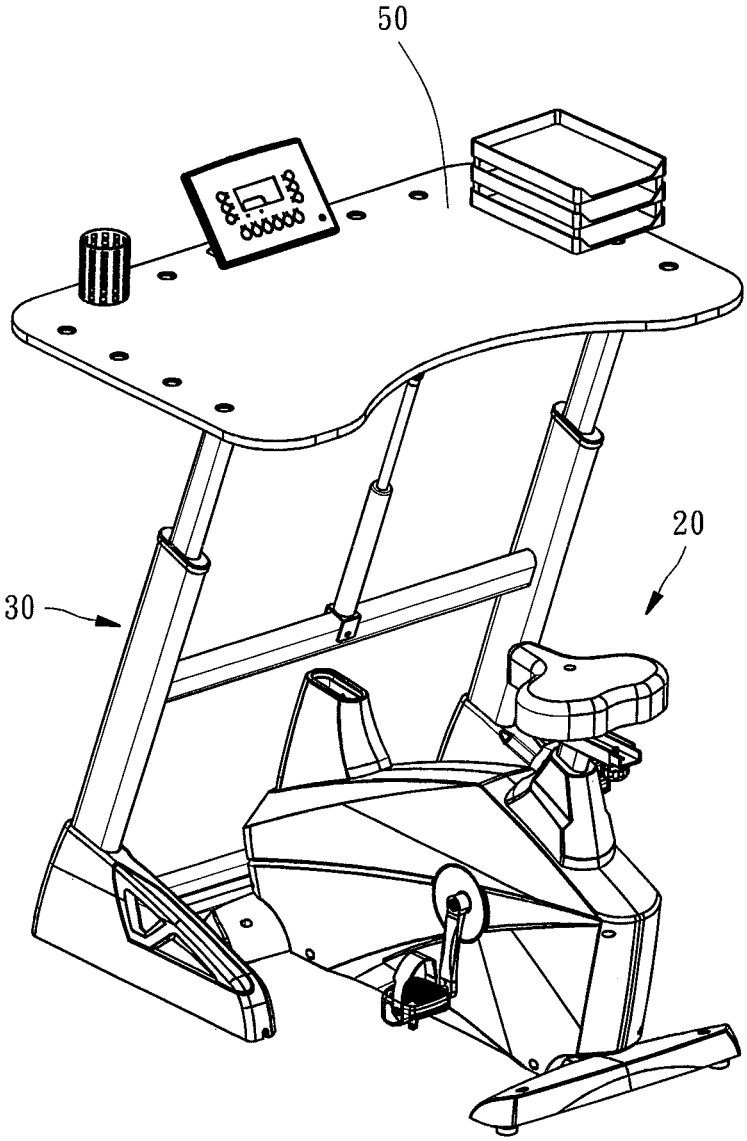
FIG. 10 and FIG. 11 are a perspective view and a lateral view of the workout equipment assembly according to the second preferred embodiment of the present invention, respectively, to further embody FIG. 8.
Figure 11:
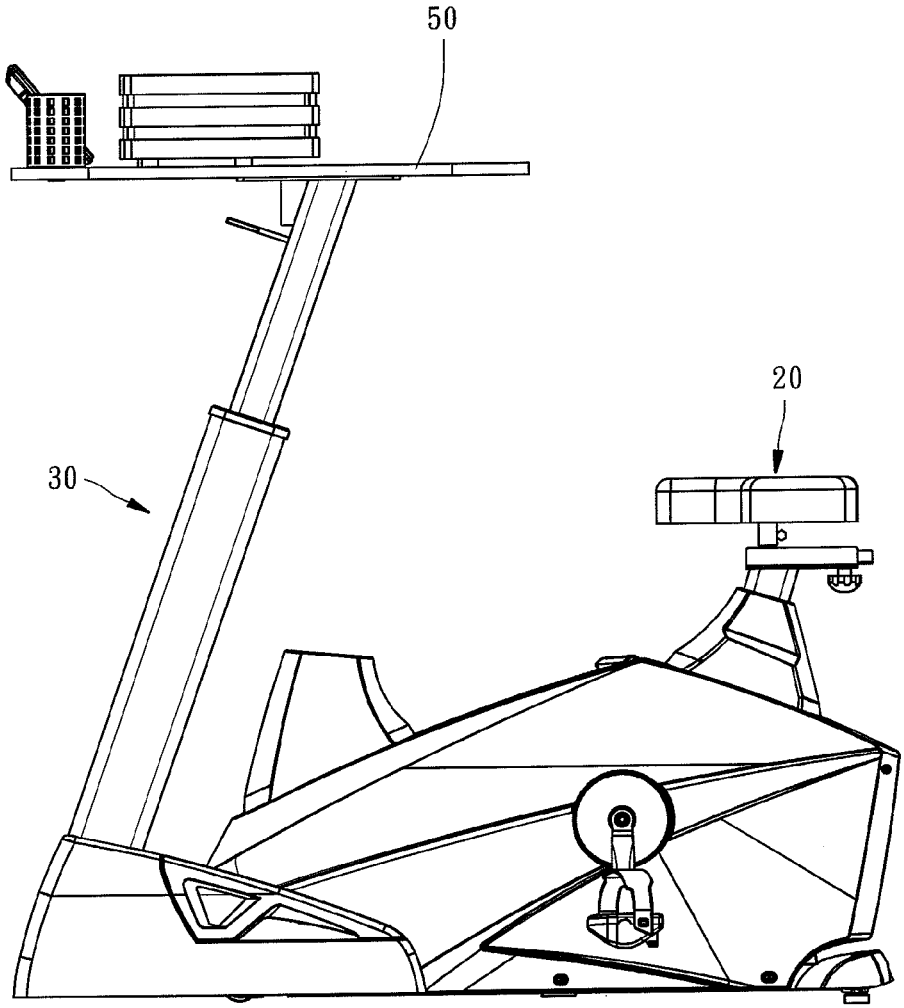

In this embodiment, the workout equipment 20 is a treadmill which is different from a conventional treadmill in that the front end of the treadmill does not have any vertical rod or any operation panel. Hence, the height of the front end of the workout equipment 20 is much less than the maximum distance between the bottom surface 52 of the table board 50 and the receiving space 44 of the base 40. Hence, the user can easily push the workout equipment 20 forward toward the table 30 and thereby put the front end of the workout equipment 20 in the receiving space 44 of the table 30. In doing so, a book, a work-related document, a notebook computer, and stationery can be put on a top surface 54 of the table board 50 to enable the user to exercise and work concurrently and conveniently. The table 30 operates in conjunction with any workout equipments that come in various types. Referring to FIG. 8, FIG. 10, and FIG. 11, the workout equipment 20 in the second preferred embodiment of the present invention is a fitness bicycle. Referring to FIG. 9, the workout equipment 20 in the third preferred embodiment of the present invention is an elliptical trainer. The user can adjust the height of the table board 50 quickly and easily by making reference to the height of the workout equipment. Therefore, the user can work by means of the table 30 while taking various exercise by means of various workout equipments.

Figure 5:
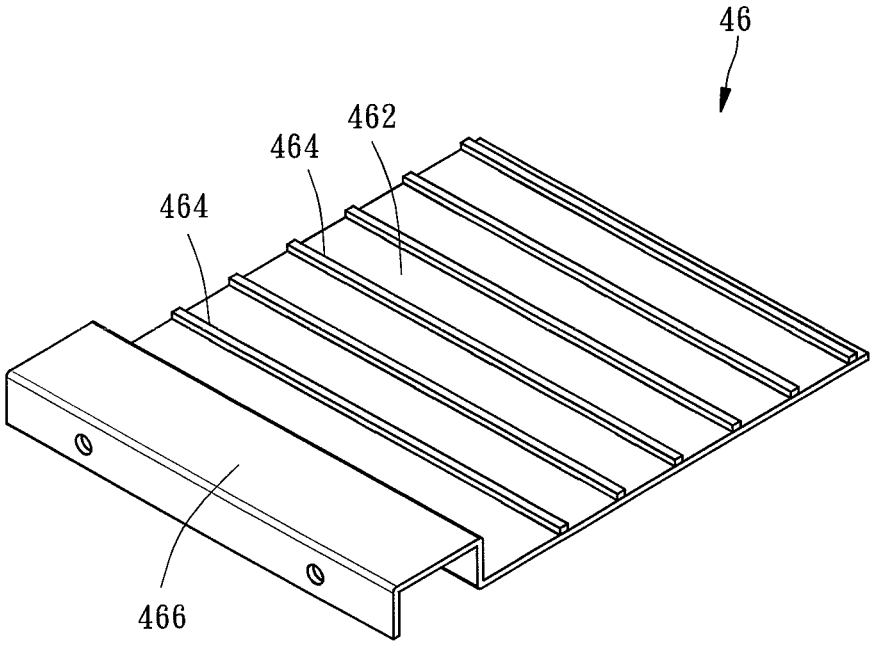
FIG. 5 is a perspective view of an anti-skid board of a table for use with a workout equipment assembly according to the first preferred embodiment of the present invention.
Figure 6:
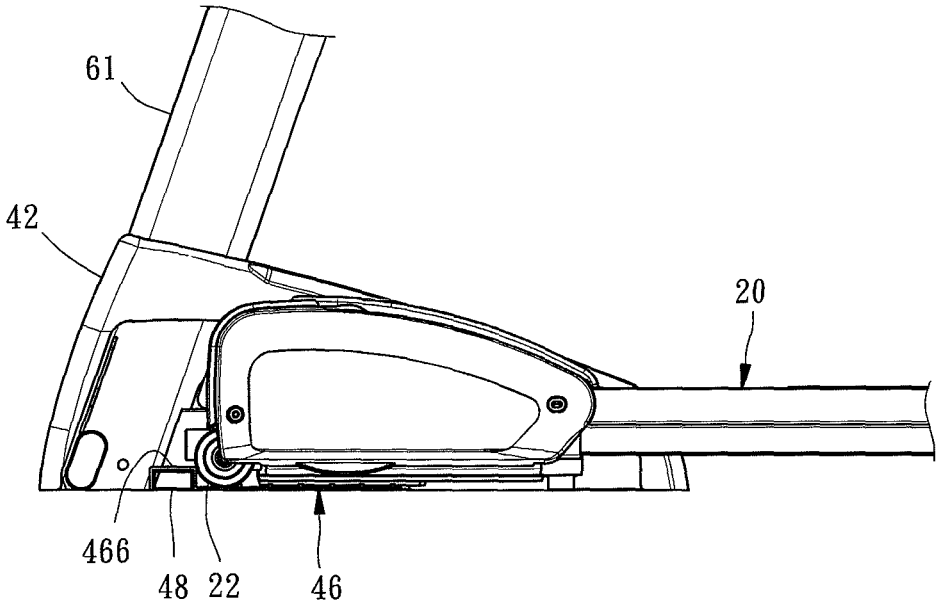
FIG. 6 is a partial lateral view of a workout equipment assembly according to the first preferred embodiment of the present invention, wherein lateral shielding portions and first vertical rods of the table are omitted for the sake of easy illustration.

To prevent the workout equipment 20 from sliding relative to the table 30 in the course of operation, wheels 22 are disposed at the bottom of the workout equipment 20 to enhance the ease of moving the workout equipment 20, whereas two anti-skid boards 46 are disposed at the base 40 of the table 30 and positioned in the receiving space 44. Referring to FIG. 5 and FIG. 6, the anti-skid boards 46 each have an upper surface 462 and a plurality of ridges 464 protruding from the upper surface 462. The ridges 464 confine the wheels 22 to the anti-skid boards 46. In this embodiment, the base 40 further has a fixing rod 48 fixedly disposed between the two lateral shielding portions 42. A straddling member 466 straddling the fixing rod 48 is disposed at the front end of each of the anti-skid boards 46. The front side of the straddling member 466 is fastened to the fixing rod 48 by at least a screw. Hence, the anti-skid boards 46 effectively offsets a backward force the user exerted upon the workout equipment 20. Nonetheless, the aforesaid arrangement and positions of the anti-skid boards 46 are not restrictive of the present invention.

Figure 7:
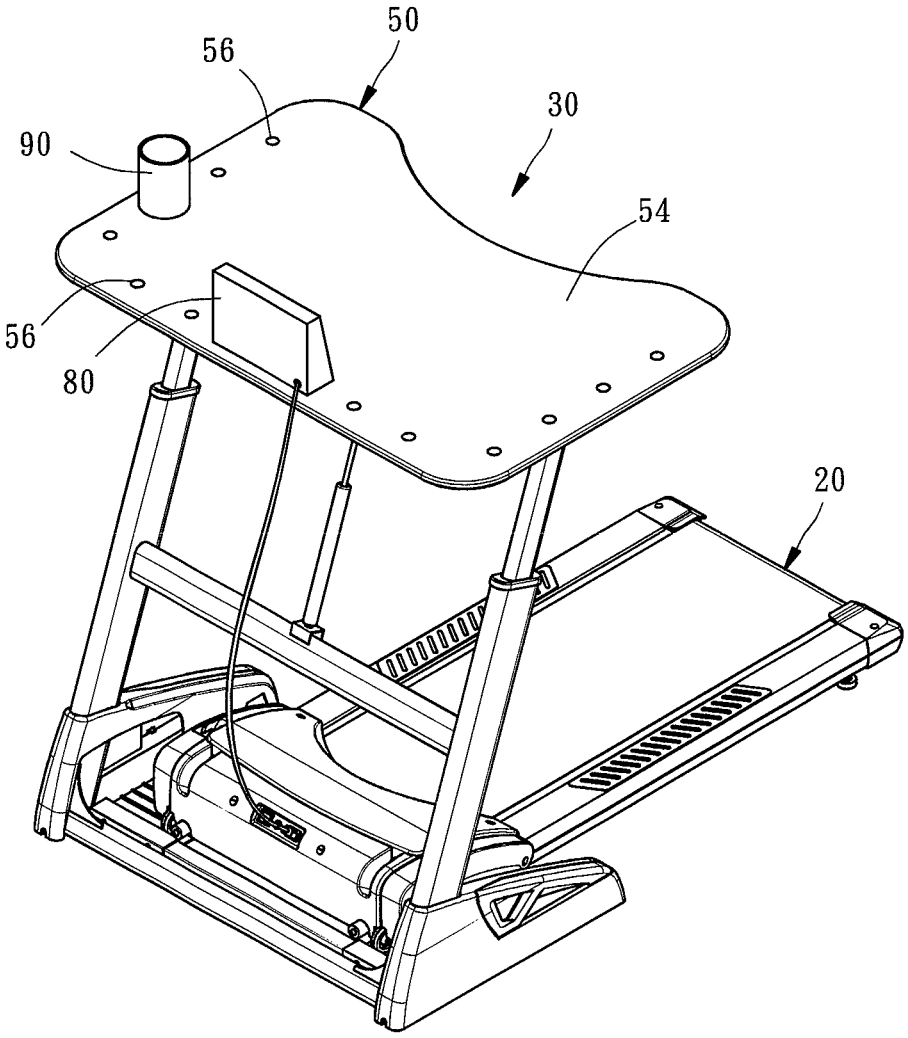
FIG. 7 is similar to FIG. 1 except that the workout equipment assembly further comprises a controller and a pen holder.
Figure 12:
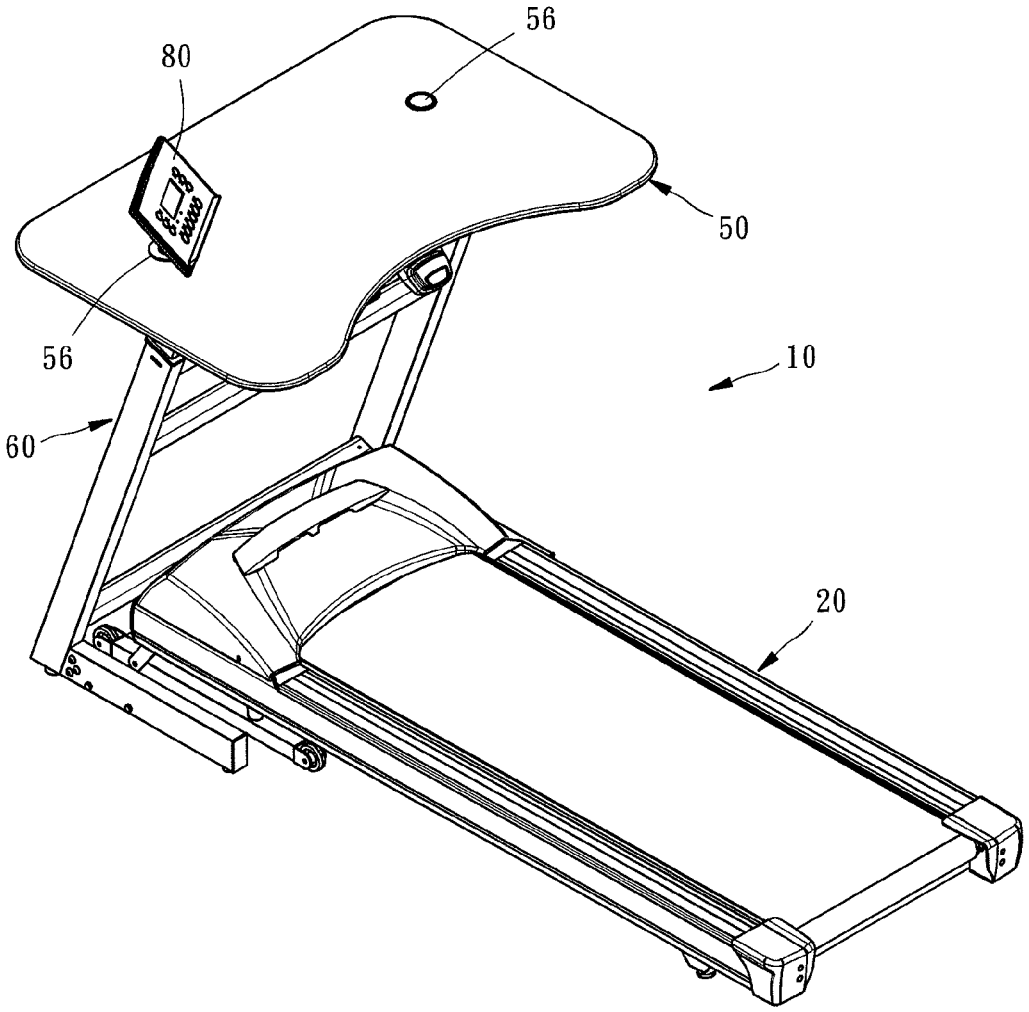
FIG. 12 is an assembled perspective view of a workout equipment assembly according to a fourth preferred embodiment of the present invention.
Figure 13:
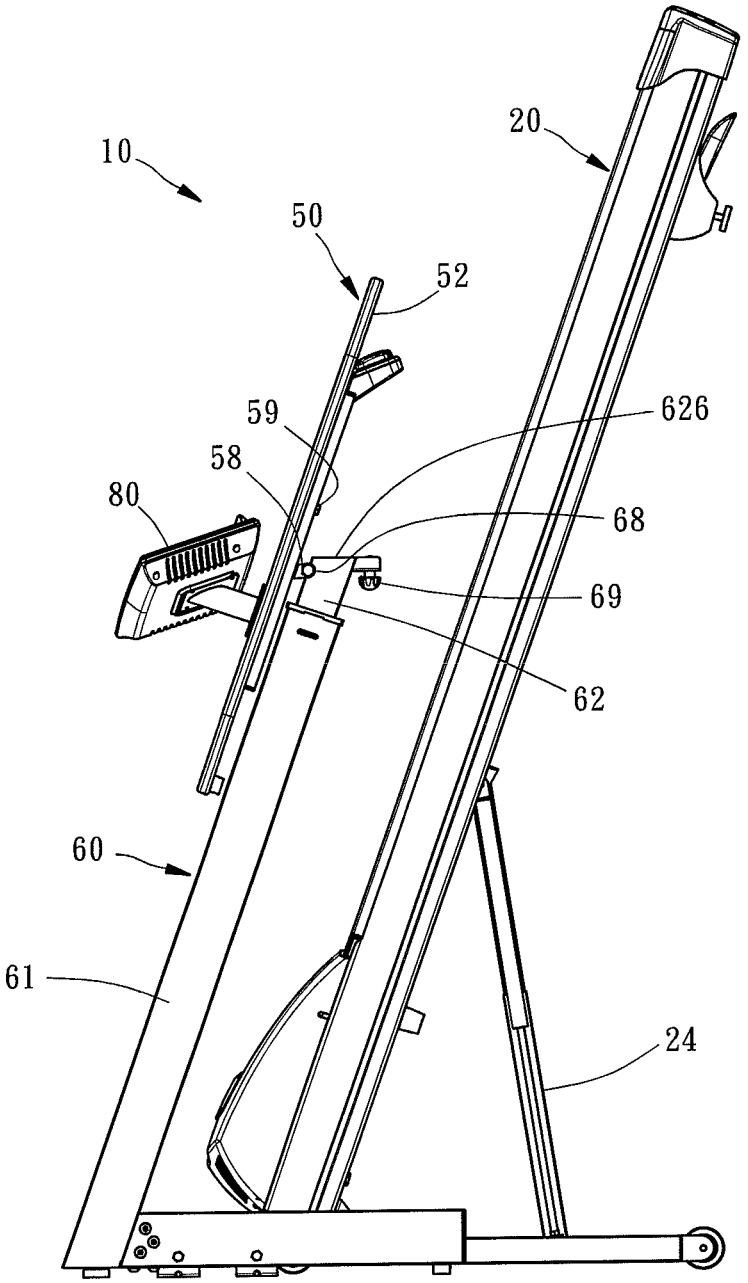
FIG. 13 is a schematic view of a workout equipment assembly in a folded state according to a fourth preferred embodiment of the present invention.

Referring to FIG. 12 and FIG. 13, to enable the workout equipment assembly 10 in the fourth preferred embodiment of the present invention to occupy less space when unused, the present invention is characterized in that a pivot ear unit 58 and a fixing element 59 are disposed on the bottom surface 52 of the table board 50. The second vertical rods 62 of the supporting stand 60 each have an upper end surface 626. A pivotal connection unit 68 facing the upper end surface 626 is disposed on the front side 622 of the second vertical rods 62. A fixing base 69 is disposed on the upper end surface 626. The pivot ear unit 58 is pivotally coupled to the pivotal connection unit 68 and adapted to enable the table board 50 to swing by an included angle formed by the front side 622 and the upper end surface 626. A fixing base 69 is disposed on the upper end surface 626 of the second vertical rods 62. The fixing base 69 corresponds in position to the fixing element 59 to allow the table board 50 to be fixed to the supporting stand 60. In the above embodiment, the fixing element 59 and the fixing base 69 come in the form of a bolt and a screw nut, respectively. The process of folding up the table 30 involves: loosening a screw nut 69 on the upper end surface 626 of the second vertical rods 62 to separate the thread of the screw nut 69 from the bolt 59 on the bottom surface 52 of the table board 50; and coupling pivotally the pivot ear unit 58 of the table board 50 and the pivotal connection unit 68 of the supporting stand 60 together to allow the table board 50 to be parallel to the supporting stand 60. Afterward, since the workout equipment 20 in this embodiment comes in the form of a treadmill 20, the process of folding up the workout equipment 20 is disclosed in the prior art and involves: lifting the rear platform of the treadmill 20 to allow the treadmill 20 to be substantially parallel to the supporting stand 60; and keeping the treadmill 20 in the aforesaid state with a supporting unit 24. Hence, the present invention is advantageously characterized in that the table 30 and the workout equipment 20 can be folded up to occupy less space when unused and thus is space-saving. The workout equipment 20 is equipped with a simple on/off button (not shown) for the user to operate. Referring to FIG. 7, the workout equipment 20 is electrically connected to a controller 80. The controller 80 enables the user to further control the operation of the workout equipment 20 in terms of speed and operation duration. In this embodiment, the table board 50 of the table 30 has a plurality of installation holes 56. At least a post (not shown) corresponding in shape to the installation holes 56 is disposed at the bottom of the controller 80, such that the controller 80 can be fixedly and insertedly disposed at at least one of the installation holes 56 to facilitate the user's operation. The installation holes 56 provide anchorage for consumer items, such as a pen holder 90, a book stand, a document stand, and a cup holder, and thus the items can be positioned on the table board 50. Referring to FIG. 12, in the fourth preferred embodiment of the present invention, the table board 50 of the table 30 has two said installation holes 56, such that the controller 80 can be directly disposed above the installation holes 56. Therefore, the controller 80 is electrically connected to a cable (not shown) of the workout equipment 20 and thus is hidden inside the hollow casing of the supporting stand 60 to thereby enhance its beauty and security. The constituent elements described in the aforesaid embodiments of the present invention are illustrative rather than restrictive of the scope of the present invention. Any other equivalent elements for use in making any replacement and change to the aforesaid embodiments of the present invention shall be deemed falling within the scope of the claims of the present invention.

What is claimed is:

1. A table for use with a workout equipment, the table comprising:

a base having a front shielding portion, two lateral shielding portions extending backward from the front shielding portion, and a receiving space defined by the front shielding portion and the two lateral shielding portions, such that a front end of the workout equipment is disposed in the receiving space;

a table board; and a supporting stand disposed between the base and the table board and being of a length adjustable to change a distance between the table board and the base wherein the supporting stand comprises two first vertical rods, two second vertical rods, a first transverse rod fixedly disposed between the two first vertical rods, and a second transverse rod fixedly disposed between the two second vertical rods, wherein the two first vertical rods are fixedly disposed on the two lateral shielding portions, respectively, wherein the two second vertical rods are slidably nested in the two first vertical rods, respectively.

2. The table of claim 1, further comprising a pneumatic unit with two ends fixed to the base and the table board, respectively, such that the pneumatic unit is operable by a user to thereby adjust the distance between the table board and the base.

3. The table of claim 2, wherein two ends of the pneumatic unit are fixed to the first transverse rod and the second transverse rod, respectively.

4. The table of claim 3, wherein at least a roller is disposed between the first vertical rods and the second vertical rods.

5. The table of claim 4, wherein the first vertical rods and the second vertical rods extend obliquely upward and backward, wherein the second vertical rods each have a front side and a back side behind the front side, wherein a roller is disposed between the front side of each of the second vertical rods and the first vertical rods, wherein two rollers are disposed between the back side of each of the second vertical rods and the first vertical rods.

6. The table of claim 5, wherein the table board has a bottom surface facing the receiving space of the base and having a pivot ear unit, wherein the second vertical rods of the supporting stand each have an upper end surface, wherein a pivotal connection merit facing the upper end surface is disposed on the front side of the second vertical rods, wherein the pivot ear unit is pivotally coupled to the pivotal connection unit and adapted to enable the table board to swing by an included angle formed by the front side and the upper end surface.

7. The table of claim 6, wherein a fixing element is disposed on the bottom surface of the table board, wherein a fixing base is disposed on the upper end surface of each of the second vertical rods, wherein the fixing base corresponds in position to the fixing element to allow the table board to be fixed to the supporting stand.

8. The table of claim 7, wherein the base further comprises an anti-skid board disposed in the receiving space and having an upper surface and a plurality of ridges protruding from the upper surface for confining the workout equipment to the anti-skid board.

9. The table of claim 8, wherein the base further has a fixing rod fixedly disposed between the two lateral shielding portions, wherein a straddling member straddling the fixing rod is disposed at the front end of each of the anti-skid boards.

10. The table of claim 9, wherein the table board has an installation hole.

11. The table of claim 10, further comprising a controller electrically connected to the workout equipment and disposed at the installation hole of the table board.

* * * * *